United States Patent [19]

Morris

[11] 4,020,984

[45] May 3, 1977

[54] SNAP-ON BOW-MOUNTED QUIVER

[76] Inventor: George W. Morris, 11889 Kilgore, Sunnymead, Calif. 92388

[22] Filed: Aug. 1, 1975

[21] Appl. No.: 601,336

[52] U.S. Cl. ..... 224/1 B; 124/24 A; 124/88

[51] Int. Cl. ..... F41c 33/00

[58] Field of Search ..... 124/45, 24 R, 24 A, 124/23 R, 23 A, 30 R, 48, 41 R, 41 A; 224/1 B; 273/81.2

[56] References Cited

UNITED STATES PATENTS

| | | | |
|---|---|---|---|
| 3,116,730 | 1/1964 | Tingley | 224/1 B X |
| 3,777,734 | 12/1973 | Rose | 124/24 A |

FOREIGN PATENTS OR APPLICATIONS

| | | | |
|---|---|---|---|
| 437,905 | 11/1935 | United Kingdom | 273/81.2 |

*Primary Examiner*—Richard C. Pinkham
*Assistant Examiner*—William R. Browne
*Attorney, Agent, or Firm*—Herbert E. Kidder

[57] ABSTRACT

A break-away, snap-on quiver and mounting assembly for use with an archery bow having a central handle section. The quiver includes upper and lower end members joined together by a connecting rod; the upper end member having an inverted cup to receive and shield the pointed ends of the arrows, and the lower end member having spring clips to grip the shafts of the arrows near their feathered ends. Each of the end members has an attachment bracket that cooperates with a mounting bracket on the bow when the brackets are slidably engaged with one another. Spring-loaded detents on the attachment brackets engage sockets on the corresponding mounting bracket to provide a yieldable connection that allows the quiver to break away from the bow if subjected to a separating force of sufficient strength to overcome the detents. The quiver is snapped onto the bow by merely lining up the attachment brackets with their respective mounting brackets and then pressing them together, so as to force the brackets into interlocking engagement against the spring resistance of the detents.

1 Claim, 8 Drawing Figures

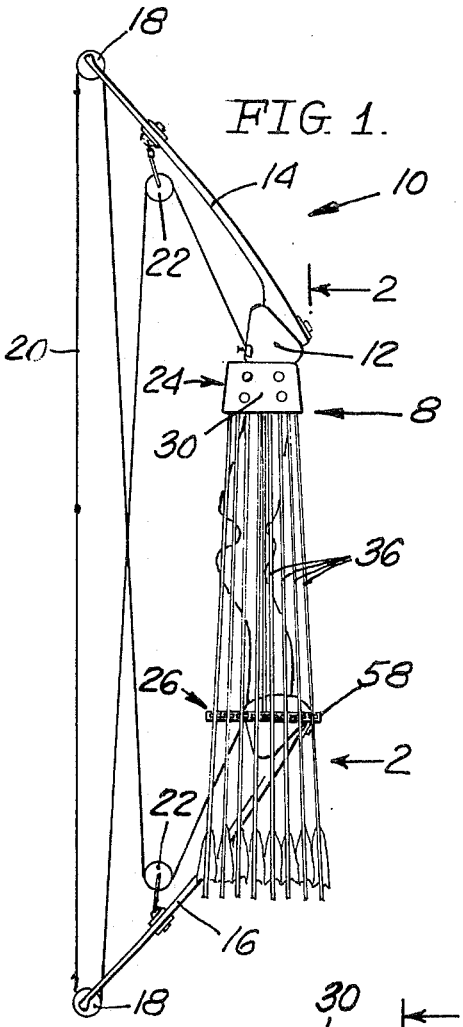
FIG. 1.
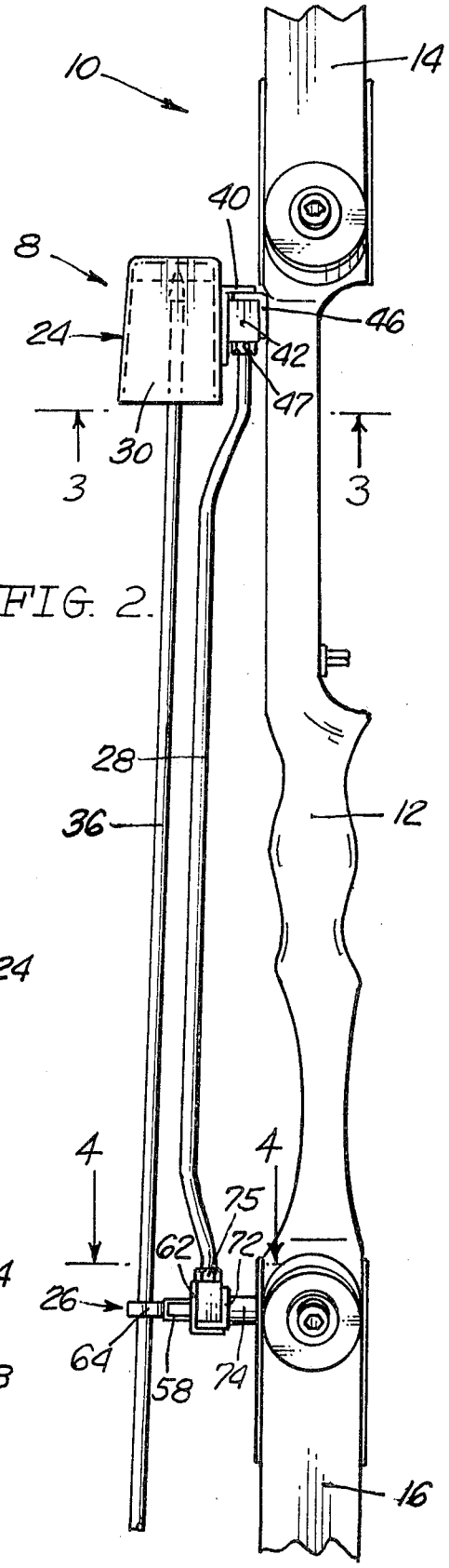
FIG. 2.
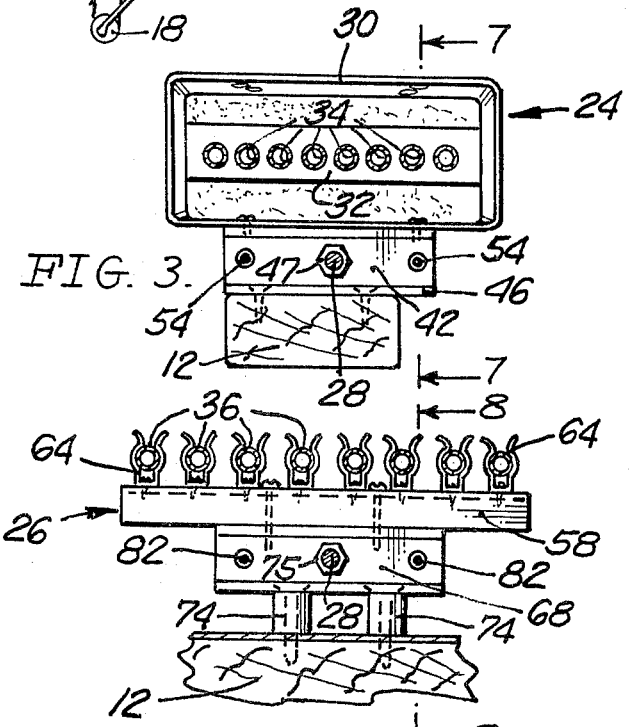
FIG. 3.
FIG. 4.

SNAP-ON BOW-MOUNTED QUIVER

BACKGROUND OF THE INVENTION

The present invention pertains generally to archery equipment, and more particularly to a quiver that is mounted on the bow for holding a plurality of arrows. Bow-mounted quivers are known in the art, and are generally used when hunting, as they hold the arrows out in front of the archer, and in a readily accessible location for quick and easy selection and withdrawal.

One problem common to all bow-mounted quivers is that if the archer should fall while negotiting a difficult trail in pursuit of his quarry, or otherwise drop the bow, the quiver may be broken when the bow hits the ground, which usually breaks or damages the arrows, and sometimes damages the bow itself. At other times, while pushing through heavy brush the quiver may be caught in the underbrush and damaged before the archer is able to stop and disengage it. Even in competition shooting, it sometimes happens that the bow-mounted quiver is damaged by being brushed against by another competitor, or by having the bow inadvertently fall to the ground. Another not uncommon mishap is for the riser, or handle section, of the bow to break when the bow is being drawn, which almost invariably breaks the conventional bow-mounted quiver.

SUMMARY OF THE INVENTION

The primary object of the present invention is to provide a new and improved bow-mounted quiver that snaps onto the bow with spring-loaded detents in such a manner that the quiver will readily break away from the bow without being damages when it runs into an obstruction, or falls to the ground, or the riser of the bow breaks.

Another object of the invention is to provide a bow-mounted quiver that is quickly and easily detached from the bow by merely pulling it away from the latter, so that the quiver and its arrows can be carried separately from the bow or mounted on a wall or other storage location. The quiver is detachably secured to brackets that are permanently attached to the bow, and is held by spring-loaded detents that provide a firm grip to resist the stresses of normal usage, while at the same time yielding to allow the quiver to break away from the bow under any abnormal force.

Another object of the invention is to provide a bow-mounted quiver that can be quickly and easily mounted on or detached from the bow, without requiring the use of any tools or other accessory equipment.

A further object of the invention is to provide a bow-mounted quiver that can be taken down into three individual pieces for convenience of packing when back-packing into remote wilderness areas.

Still a further object of the invention is to provide a bow-mounted quiver that cooperates with the handle section of the bow to provide a wide, stable base so that the bow and quiver can be set up on the ground, standing on edge, with the plane of the bow and string perpendicular to the ground surface.

These and other objects and advantages of the present invention will become apparent to those skilled in the art from consideration of the following detailed description of the preferred embodiment thereof, with reference to the accompanying drawings.

BRIEF DESCRIPTION OF THE DRAWINGS

FIG. 1 is a side elevational view of a quiver embodiying the principles of the invention, mounted on the side of a compound bow;

FIG. 2 is an enlarged fragmentary view of the same, as seen at 2—2 in FIG. 1;

FIG. 3 is a transverse sectional view taken at 3—3 in FIG. 2;

FIG. 4 is another transverse sectional view, taken at 4—4 in FIG. 2;

DESCRIPTION OF THE PREFERRED EMBODIMENT

Figure 5:
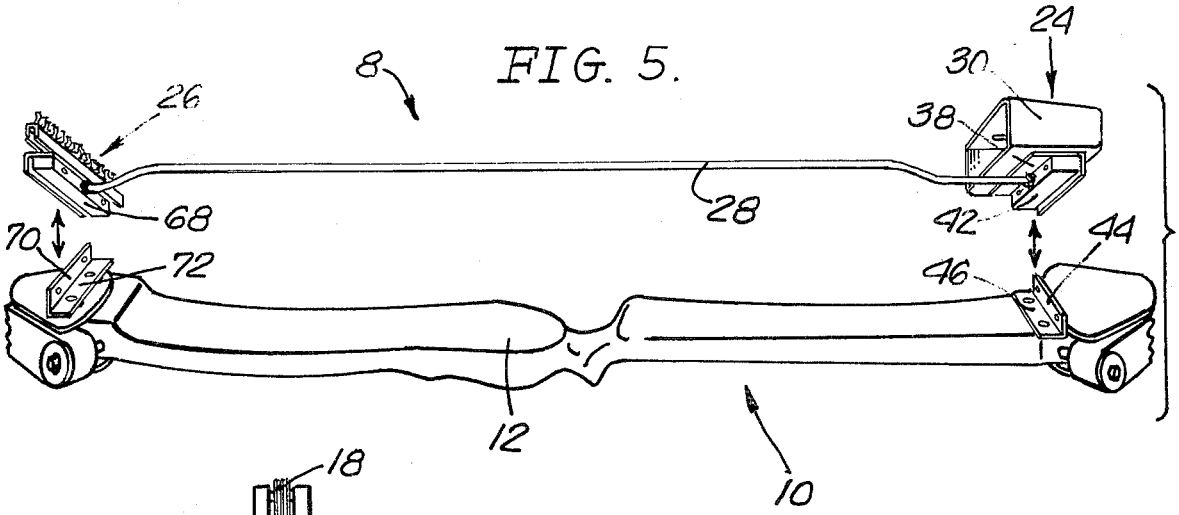
FIG. 5 is a fragmentary perspective view, showing the quiver broken away from its mounting brackets on the bow.
Figure 6:
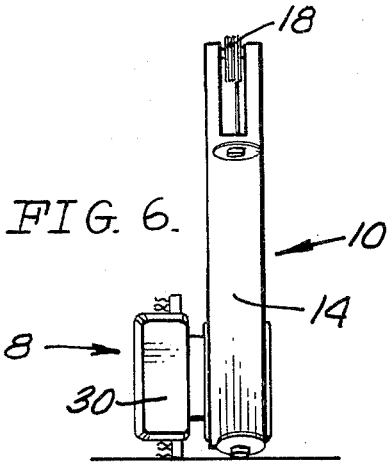
FIG. 6 is an end view of the bow, showing how the bow and quiver cooperate to provide a wide base for standing the bow on the ground.

FIG. 1 shows the quiver 8 of the present invention mounted on a compound bow 10 of a type generally similar to that illustrated and described in U.S. Pat. No. 3,486,495 to H. W. Allen. Bow 10 is provided with a contoured central riser, or handle section, 12 having a pair of upper and lower limbs 14 and 16, respectively, attached to opposite ends thereof. Journaled at the outer ends of limbs 14, 16 are eccentric pulley wheels 18, and trained around these wheels is a bowstring 20, which also passes around the idler wheels 22 to points of attachment at the ends of handle section 12.

The compound bow 10 forms no part of the present invention, except that it provides support for the quiver 8. The quiver 8 comprises upper and lower end members 24 and 26, respectively, which are mounted on the ends a connecting rod 28. Rod 28 is bent outwardly from the bow handle section 12 a slight amount, as best shown in FIG. 2, to provide clearance for the archer's hand.

Figure 7:
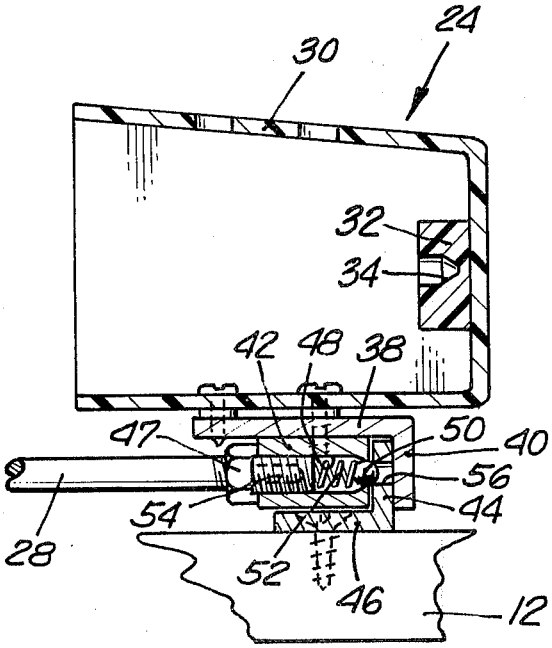
FIG. 7 is an enlarged fragmentary sectional view taken at 7—7 in FIG. 3.

The upper end member 24 is in the form of an inverted cup 30, and cemented to the bottom of the cup is a tranverse strip 32 of rubber or soft plastic, having a plurality of cavities 34 formed therein, to receive the heads of arrows 36. The side of cup 30 facing the bow has an L-shaped bracket 38 mounted thereon, one flange 40 of which extends perpendicularly from the cup side. Attached to the base flange of bracket 38 is a rectangular metal block 42, one edge of which is parallel to flange 40 and spaced away from the same just far enough to receive the upstanding flange 44 of an L-shaped mounting bracket 46 which is attached to the handle section 12 of the bow. This is best shown in FIG. 7. The threaded top end of rod 28 screws into a tapped hole at the midpoint of block 42 (see FIG. 2) and is secured by a lock nut 47.

Formed in the block 42 near oposite ends thereof are parallel cylindrical bores 48, and contained within each bore is a steel ball 50 which is urged in one direction by a compression spring 52. Spring 52 bears against a set screw 54, which is threaded into one end of the bore 48. The other end of the bore 48 is pinched in slightly, so that the ball 50 is allowed to project for about one-third of its diameter beyond the edge surface of the block 42. The ball 50 is thus free to yield inwardly against the pressure of the spring 52, but is prevented by the pinched-in end of the bore 48 from leaving the bore.

When the assembly is joined together as shown in FIG. 7, ball 50 seats in a socket formed by a hole 56 in the upstanding flange 44 of mounting bracket 46. The projection of the ball 50 into the socket 56 prevents relative movement of the block 42 and bracket 38 with respect to mounting bracket 46 unless the ball is first pushed back into its bore against the pressure of spring 52. Thus, the spring-loaded ball 50 serves as a yieldable detent, securing the brackets 38 and 46 together, and this detent can be overcome by an outward tug on the upper end of member 24, or by any other separating force sufficiently strong to cause the ball 50 to be cammed back into its bore 48 by pressure of one side of the hole 56 acting against it.

Figure 8:
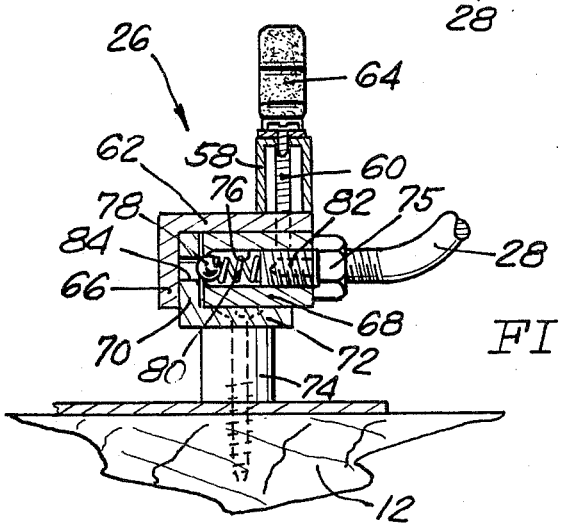
FIG. 8 is an enlarged fragmentary sectional view taken at 8—8 in FIG. 4.

The lower end member 26 consists of a transversely extending, elongated, inverted channel 58, which is secured by screws 60 to the top surface of an L-shaped bracket 62 (see FIG. 8). Attached by screws to the top side of inverted channel 58 is a plurality of U-shaped spring clips 64, which are adapted to receive and yeildingly grip the shafts of the arrows 36. Bracket 62 has a downwardly projecting flange 66, and attached to the underside of bracket 62 is a rectangular meal block 68, block 68 has one edge parallel to flange 66 and spaced away therefrom a distance only slightly greater than the thickness of an upstanding flange 70 of an L-shaped mounting bracket 72 that is attached to the handle section 12 of the bow. Bracket 72 is spaced outwardly from the handle section 12 a short distance by means of cylindrical spacers 74 (FIG. 8), and the attaching screws pass through the hollow centers of the spacers. The purpose of the spacers 74 is to space the feathered ends of the arrows slightly out from the bow, so as to prevent contact between the feathers and the bow, and also to make is somewhat easier to grasp the feathered ends of the arrows. The bottom end of rod 28 is threaded, and is screwed into a tapped hole at the midpoint of block 68. A lock nut 75 prevents any rotation of block 68 with respect to rod 28.

Formed in block 68 near opposite ends thereof are parallel cylindrical bores 76, and contained within each bore is a steel ball 78 which is urged outwardly (i.e., to the lft in FIG. 8) by a compression spring 80. Spring 80 bears at its other end against a set screw 82, which is threaded into one end of the bore 76. The other end of the bore 76 is pinched in slightly so as to retain the ball, while allowing it to project for about one-third of its diameter beyond the edge surface of the block 68. Ball 78 seats within a socket formed by a hole 84 in upstanding flange 70 of mounting bracket 72. The spring-loaded balls 778 of the lower end member 26 thus serve the same function as the spring-loaded balls 50 of the upper end member 24, providing yieldable detents that secure the brackets 62 and 72 together, while at the same time allowing bracket 62 to break away from bracket 72 responsive to an outward tug on the quiver, or to any other separation force sufficiently strong to cause the ball 78 to be cammed back into its bore 76 by pressure of one side of the hole 84 acting against it.

The upper and lower end members 24 and 26, being joined together by rod 28, form a unitary quiver 8, which can be separated from the bow 10, either with or without arrows 36. Thus, the quiver and arrows can be removed as a unit from the bow and hung on a wall, or otherwise stored, separated from the bow. It is also advantageous at times to separate the quiver from the bow while transporting them in a car or other vehicle.

To mount the quiver on the bow, all that is required is to place the upper and lower end members 24, 26 directly over their respective mounting brackets 46, 72, with flanges 44 and 70 started in the openings between bracket flanges 40, 66, respectively, and their associated blocks 42 and 68. The upper and lower end members 24, 26 are then pressed toward the bow, which causes the spring-loaded balls 50 and 78 to yield inwardly, allowing flanges 44, 70 to seat fully within their respective slots. As the flanges 44, 70 become fully seated, spring-loaded balls 50, 78 drop into their respective sockets 56, 84, locking the mounting brackets together.

To remove the quiver from the bor, an outward tug on the upper and lower end members 24, 26 is all that is required to overcome the spring-loaded detents 50, 78. More importantly, if the archer should fall of drop the bow, any separating force or impact against any part of the quiver due to striking the ground or other objects will cause the quiver to break away from the bow, as in FIG. 5, without damage to either the quiver or the bow. In the event that one limb 14, 16 of the bow should break while the bow is being drawn, quiver 8 will break away from the handle section 12 without being damaged.

One advantageous feature of the invention is that the spring-load on the detents can be adjusted to any desired value by merely turning the set-screws 54 and 82 in the appropriate direction. To increase the spring pressure on detent balls 50 and 78, the corresponding set-screws are turned inwardly so as to compress the springs 52, 80. Thus, the spring-loaded detent balls can be tightened up to the point where considerable force is required to break the quiver away from the bow, or alternatively, they can be loosened so that only a slight effort will cause the quiver to break away.

Another advantage of the invention is that the quiver can be quickly and easily taken down to three separate parts for ease in packing, when back-packing into remote wilderness areas.

While I have shown and described in considerable detail what I believe to be the preferred form of my invention, it will be understood by those skilled in the art that the invention is not limited to such details, but may take various other forms within the scope of the appended claims.

What I claim is:

1. A quick-detachable, snap-on quiver and mounting assembly on an archery bow having a central handle section, said quiver and mounting assembly comprising, in combination:

a pair of spaced-apart mounting brackets adapted to be mounted on the handle section of a bow, each of said mounting brackets consisting of an angle member having a first flange adapted to be fixed to the handle section and a second flange projecting laterally from one side of a bow, said second flanges of said pair of angle members being parallel to one another and adapted to be in planes perpendiculr to the longitudinal axis of a bow;

upper and lower end members connected together by an intermediate member;

one of said end members being provided with means to receive and shield the pointed ends of a plurality of arrows;

the other of said end members having spring clips that yieldingly engage and releasably hold the shafts of the arrows near the feathered ends thereof;

attachment brackets on said upper and lower end members cooperating with said mounting brackets, each of said attachment brackets having a pair of opposed parallel surfaces that are spaced apart to receive between them the said second flange of the corresponding mounting bracket; and each of said attachment brackets having a spring-loaded detent ball protruding from one of said surfaces that seats in a socket formed in said second flange of the mounting bracket, so as to provide a yielding connection between them resisting relative movement of the attachment bracket relative to its correspondiing mounting bracket, said spring-loaded detent ball being yieldable under a predetermined separating force to allow the quiver to break away from a bow;

said end members being snapped onto their respective mounting brackets by pressing them together with sufficient pressure to overcome said spring-loaded detent balls.

* * * * *